United States Patent [19]

Kocks, deceased et al.

[11] 4,091,524

[45] May 30, 1978

[54] PROCESS FOR PRODUCING PIPE BLOOMS

[75] Inventors: Friedrich Kocks, deceased, late of Dusseldorf, Germany; by Jutta Kocks, heir, Wermelskirchen, Germany

[73] Assignee: Ali Bindernagel, Dusseldorf-Gerresheim, Germany

[21] Appl. No.: 787,027

[22] Filed: Apr. 13, 1977

Related U.S. Application Data

[63] Continuation of Ser. No. 596,259, July 16, 1975, abandoned.

[30] Foreign Application Priority Data

July 19, 1974 Germany ..... 2434850

[51] Int. Cl.[2] ..... B22D 13/10; B22D 45/00

[52] U.S. Cl. ..... 29/527.7; 164/76; 164/114; 164/270

[58] Field of Search ..... 164/85, 114, 115, 116, 164/117, 118, 120, 136, 270, 298, 302, 319, 320, 337, 76; 29/526.3, 527.5, 527.7; 72/325

[56] References Cited

U.S. PATENT DOCUMENTS

| | | | |
|---|---|---|---|
| 724,270 | 3/1903 | Ehrhardt | 72/325 X |
| 866,021 | 9/1907 | Hansen | 72/325 X |
| 1,537,041 | 5/1925 | Becker | 164/76 |
| 3,581,384 | 6/1971 | Petersen et al. | 29/527.7 |
| 3,683,999 | 8/1972 | Kocks | 164/116 X |

*Primary Examiner*—Francis S. Husar
*Assistant Examiner*—Gus T. Hampilos
*Attorney, Agent, or Firm*—Buell, Blenko & Ziesenheim

[57] ABSTRACT

A process is provided for producing long tubular blooms, generally having a length to diameter ratio in excess of 20:1 in which molten material is rapidly poured into a chill mould whose axis is transverse to the horizontal, sealing the mould and immediately tilting the mould to a generally horizontal axial position while rotating about its axis, inserting a mandrel axially of the viscous center axis of the material and processing the material around the mandrel to form a tube after which the mandrel is removed.

10 Claims, 16 Drawing Figures

Figure 1:
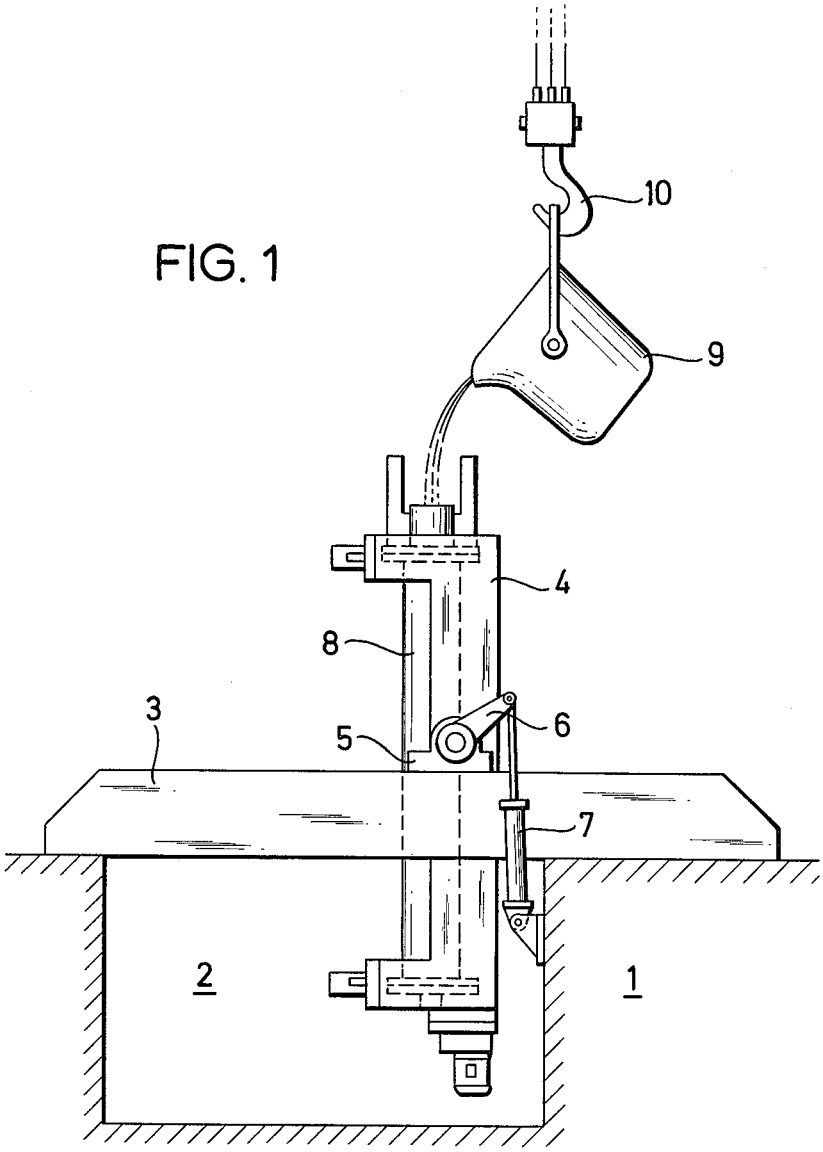

FIG. 2
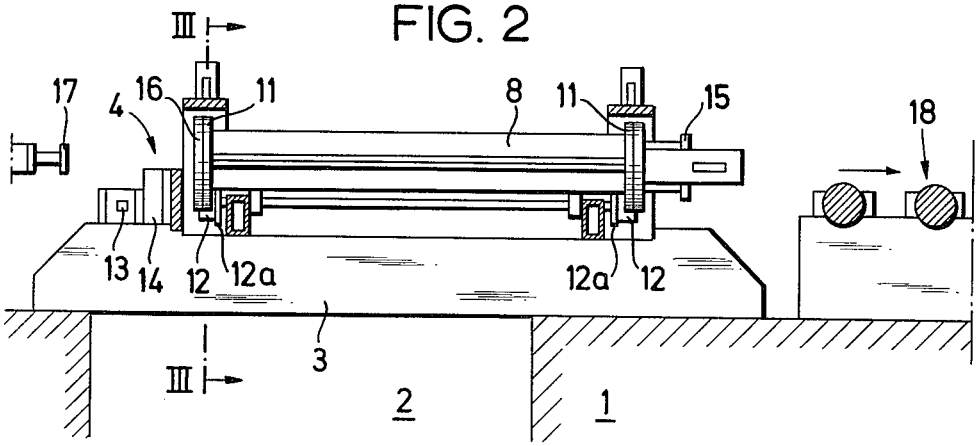
FIG. 3
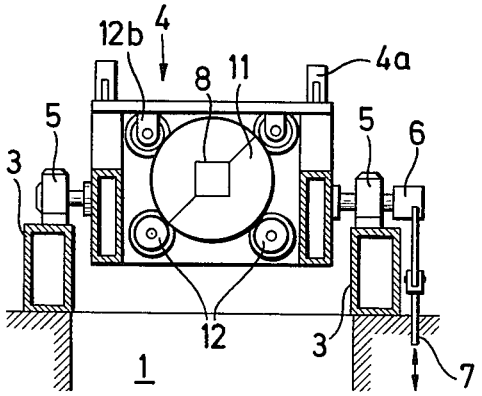
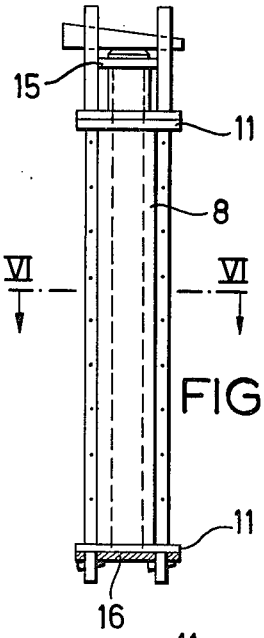
FIG. 4
FIG. 5
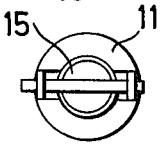
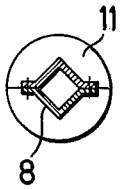
FIG. 6

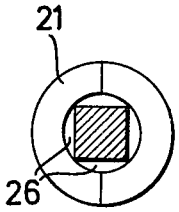
FIG. 11
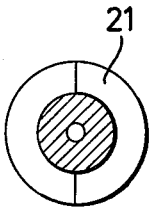
FIG. 12
FIG. 13
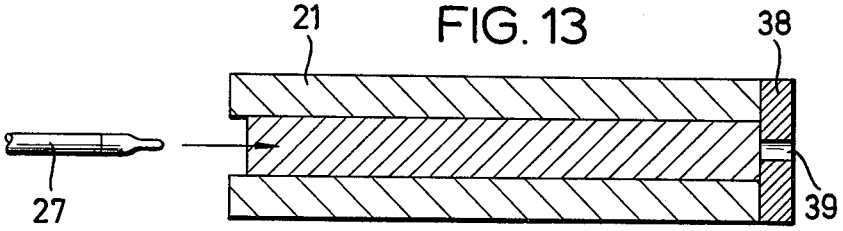
FIG. 14
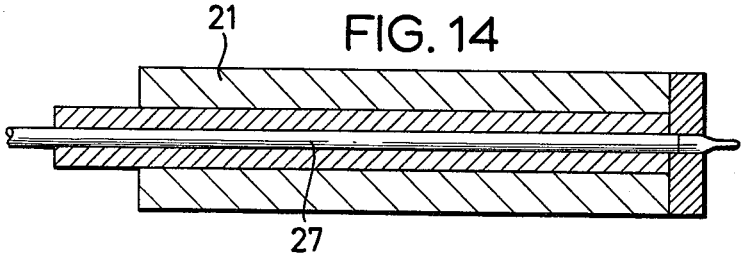
FIG. 15
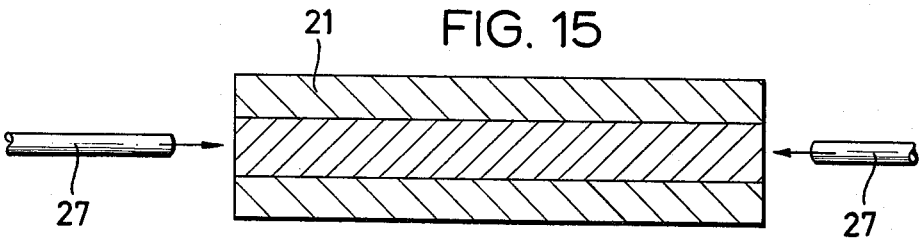
FIG. 16
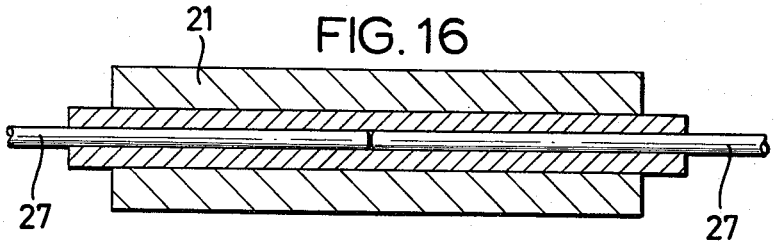

PROCESS FOR PRODUCING PIPE BLOOMS

This application is a continuation of copending application Ser. No. 596,259, filed July 16, 1975, now abandoned.

This invention relates to a process for producing pipe blooms and particularly to a process for producing very long tubular blooms, such as those blooms whose ratio of length to diameter is in excess of 20:1. In other words, with a bloom outer diameter for example of 200 mm, the bloom length is to be at least 4 m (approximately).

The invention endeavours to achieve bloom lengths of approximately 8 and 10 m with the same diameter; this corresponds to a length/diameter ratio of 40:1 and 50:1. Such great bloom lengths enable particularly economical production of seamless tubes, particularly on continuous operation installations since, in particular, the quantity of scrap end pieces, which are inevitably produced, is substantially reduced when pipe blooms serve as the starting material.

A method of casting metal is already known wherein the molten mass is poured out of a furnace or a ladle into an upright chill mould, which is sealed off directly subsequent to casting, is tilted into a horizontal position and after this tilting process is slowly moved about its longitudinal axis. However, this known method concerns the production of solid rectangular blocks with no inner bore, so that this method does not produce tubular blooms which are suitable for the production of seamless tubes. The blocks produced in accordance with this known method would first have to be provided with the inner bore and round cross sectional form characteristic of tubes before they could serve as tubular blooms as starting material for the production of seamless tubes. However, no such provision is made in the known process. The solid blocks thereby produced are particularly long, having a length/width or diameter ratio of more than 20:1, preferably of 40:1 and over. It is no longer possible to provide such long blocks with an inner bore and a round cross sectional form by means of the conventional processes, e.g. by using Erhardt punching presses, and it is therefore necessary to sub-divide the very long blocks, produced in accordance with the known process, into shorter portions. So as still to enable piercing on an Erhardt piercing press the length-/diameter ratio may not exceed 7:1. However, tubular blooms of the conventional length are again obtained so that in this manner the advantage of particularly economical production of seamless tubes cannot be realized.

Furthermore, a process is known wherein a mandrel is inserted in an axial direction into the core region of a block, which core is still viscous or even fluid, so as to provide a hollow body, which is open at one end, as a blank for the production of seamless tubes. If this process, which is also known, is used for the blocks cast in chill moulds in the normal manner, then short tubular blooms are again produced having a length/diameter ratio of up to approximately 10:1, because it is impossible for longer blocks to be cast using the conventional casting method without the so-called "piping" phenomenon taking place. Thses short tubular blooms do not enable particularly economical production of tubes.

Although the latter-mentioned known process is also provided for relatively long tubes, it is only intended for those produced on continuous casting installations. However, the use of this known process, wherein the mandrel is pressed into the core region of the block, which core is still viscous or fluid from the casting process, presents difficulties in the case of blocks produced by the continuous casting method. Thus the mandrel may only be inserted when the continuous ingot has been subdivided into blocks of the appropriate length. For the subdivision the core region must, however, no longer be fluid, since otherwise material would run out of the core region. There are also other reasons why the block produced by continuous casting, when available for piercing subsequent to the subdivision, has already substantially solidified and offers the mandrel considerable resistance. Moreover, measured along its length, it displays a temperature gradient, so that when the mandrel is inserted into the leading, cooler end portion its initial guiding is good, but then, towards the following warmer end portion, the mandrel reaches a region of decreasing solidity where the known mandrel guiding according to the process becomes increasingly worse and the mandrel may wander laterally. However, the main drawback accompanying the insertion of the mandrel is that adequate outer support for the block is lacking right at the end of the continuous casting installation, so that said block can uncontrollably spread out in a radial direction and also bend to the side.

In order to eliminate these difficulties, the proposal has already been made in connection with the known process that the blocks produced by continuous casting be brought into an equalizing or soaking furnace and the required temperatures thus be achieved. Of course, this process can also be carried out with the long blocks, which can be produced in accordance with the initially mentioned process. However, in both cases the special hot treatment for producing the temperatures required for piercing must be effected and to this end an equalizing furnace and also additional energy and cooling devices for the outer periphery of the blocks are required. This considerable additional expense nullifies the economical advantage which can be achieved by reason of the considerable length of the tubular blooms.

A feature of the present invention is to provide a process for producing very long tubular blooms, which process is not accompanied by the above-mentioned disadvantages and by means of which it is nevertheless possible to produce tubular blooms with a length/diameter ratio of more than 20:1, preferably of 40:1 and above.

In accordance with the invention the molten material is poured out of a furnace or a ladle down into an upright or slightly inclined chill mould, preferably at a high speed, the chill mould is sealed off directly subsequent to pouring, is immediately tilted into a horizontal position and during the tilting, and no later than its assuming of the horizontal position, is slowly moved about its longitudinal axis, and at least one mandrel is inserted in a longitudinal direction into the cross-sectional core zone of the solidifying cast piece, which core is still viscous or fluid from the casting process, and is thereupon guided by the cooler and firmer cross-sectional border region, and the cast piece with the mandrel inside is supplied to a device, preferably to a detaching or releasing mill, for further processing to form the tube and the mandrel is then removed.

The first thing achieved thereby is a preferably cast and sufficiently long block, whose temperatures are such that the mandrel can be inserted into the cross-sectional core region without difficulty. Additional hot treatment in a special furnace is not necessary to achieve these temperatures; rather, they are produced by the casting and subsequent cooling process which the cast piece undergoes. It has been recognized that this cooling process must be used in the initially-mentioned known method and, during this process, the second-mentioned known method must be commenced in order to obtain the very long tubular bloom desired and to preclude the disadvantages of the known processes.

Although it is basically possible to carry out the process according to the invention at a normal or only slightly increased casting speed, a particularly high casting speed is nevertheless preferred. On the one hand this represents a saving of time but it principally prevents a cross-sectional border region of any appreciable thickness from being able to solidify before the chill mould has been tilted into a horizontal position. Moreover, if this cross-sectional border region remains substantially viscous until the mould is tilted into a horizontal position, since the casting and sealing-off take only a short time, then no piping takes place because the ferrostatic pressure, which is present until the tilting into the horizontal position is efffected and which is particularly high on account of the great length of the chill mould, does not meet with a solidified outer shell which would have become detached from the chill mould wall and which said pressure would be able to burst. For this reason the quantity of material poured out of the furnace or the ladle is to be as great as possible and should possibly almost correspond to the cross-section of the chill mould, and the flow of molten material is to be measured with respect to amount such that the chill mould is full within as short a time as possible, e.g. within 20 to 40 seconds. For the same above-mentioned reason, the chill mould is also to be sealed off within as short a time as possible. The rotation of the chill mould about its longitudinal axis can commence when the chill mould is still in the vertical position. However, it should commence no later than the attainment by the mould of the horizontal position, in order to afford even cooling and a uniform structure.

When the mandrel has been inserted into the cast piece, the latter can be supplied together with the mandrel, for example to a releasing mill, in which the cast piece is widened to form a tubular bloom so that the mandrel only lies loosely in the central bore and can easily be withdrawn from the bloom. The actual bloom can then undergo further processing using known methods to give a finished tube. On the otherhand, however, it is also possible first of all to leave the inserted mandrel in the cast piece and to supply both to a skew rolling mill, a push bench or a stretch-forging machine and there to subject them to further processing, in the course whereof the mandrel also serves as a tool and is not withdrawn until later. If, for example, the device for further processing is a skew rolling mill or a stretch-forging machine, the tubular bloom can simultaneously be worked down by the mandrel.

It is advantageous if the molten material is poured into a chill mould having a square cross section, the cast piece is pushed out of the chill mould when the cross-sectional border region has solidified to a sufficient extent, said cast piece is brought into a chill mould type supporting device having a round cross-section and only when it has reached this position is pierced with the mandrel. In this manner the known difficulties are avoided which occur during the casting of blocks having a round cross-section and a tubular bloom having a circular outer cross-section is nevertheless obtained when all the steps of the process of the invention have been carried out.

The material of the cross-sectional core region, which material is still viscous or fluid, is generally forced in a basically radial direction when the mandrel is inserted. In this manner it is also possible for the cast piece which is square in cross-section to fill the larger round cross-section of the support device, which is of the chill mould type, during insertion of the mandrel, thus producing the round cross section. Alternatively, it is possible for the still viscous or fluid material of the cross-sectional core region to be displaced in a substantially axial direction as the mandrel is inserted. This applies particularly when the quantity of material displaced by the mandrel is greater than the additional space provided by the chill mould type support device as a result of its larger cross-section as compared with the chill mould itself.

In a further embodiment of the invention two mandrels can be inserted simultaneously into the cast piece, one from each end. Since the mandrels are relatively short they can more easily be guided centrally. If processing is effected in the prescribed manner it is advisable, subsequent to the meeting of the confronting end faces of the two mandrels in the middle longitudinal portion of the cast piece, to insert at least one mandrel further into the cast piece such that it extends slightly beyond this point of contact, and to withdraw the other mandrel by the corresponding amount. Any unevenness which might be produced in the region of the point of contact is thereby eliminated, so as to impart a flawless surface to the inner bore of the tubular bloom.

Figure 7:
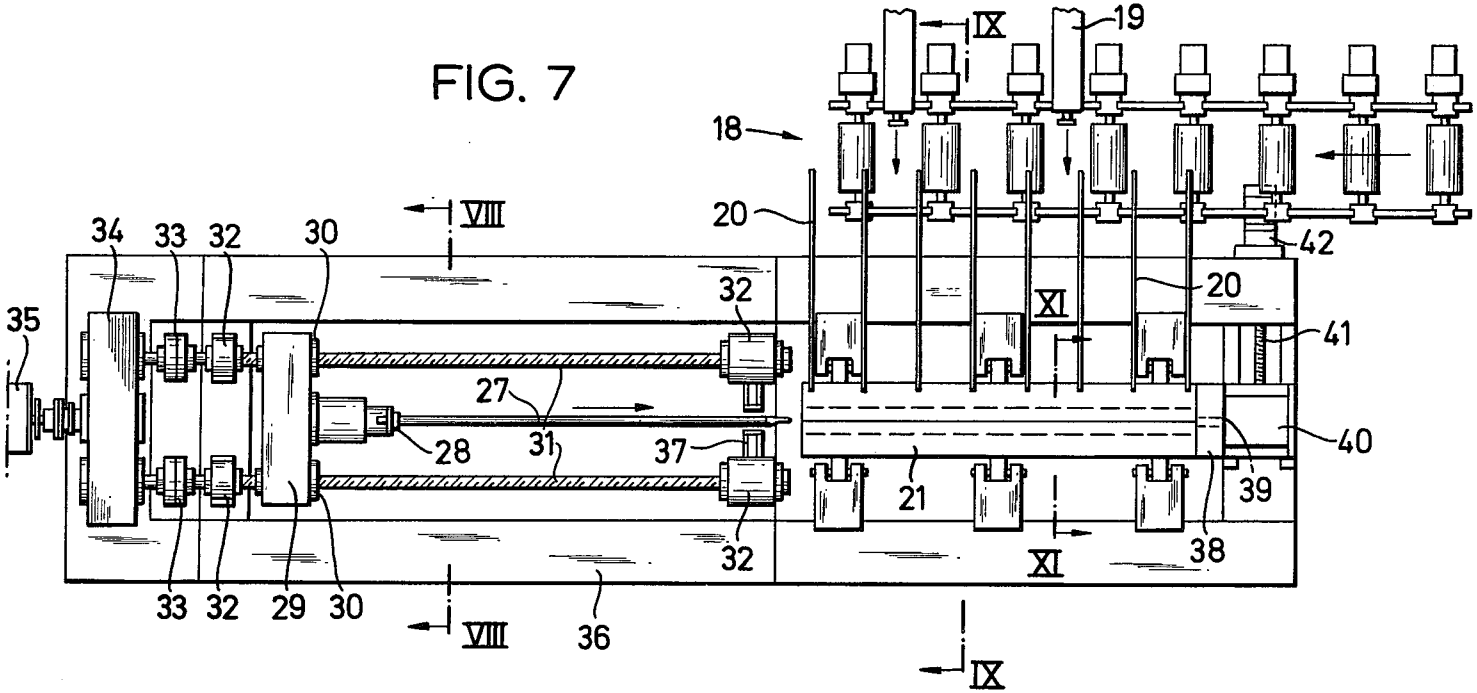
Figure 8:
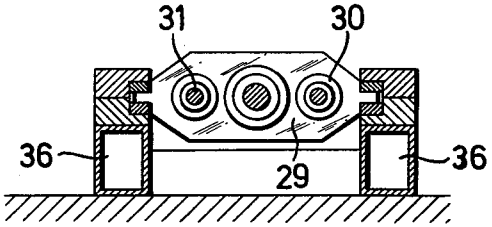
Figure 10:
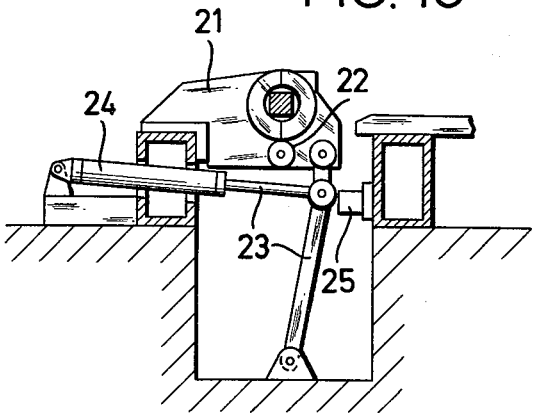
Figure 9:
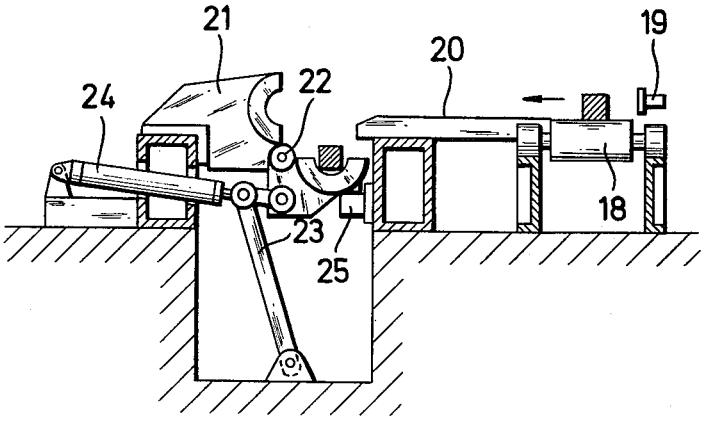

The invention is further described, by way of example, with reference to the accompanying drawings, in which:

FIG. 1 is a side view of a casting and rotating device in the casting position, FIG. 2 is a side veiw of the casting device of FIG. 1 in its rotating position, FIG. 3 is a section on the line III—III in FIG. 2, FIG. 4 is a side view of a chill mould, FIG. 5 is a plan view of the chill mould of FIG. 4, FIG. 6 is a section on the line VI—VI in FIG. 4, FIG. 7 is a plan view of a piercing device, FIG. 8 is a section on the line VIII—VIII in FIG. 7, FIG. 9 is a section on the line IX—IX in FIG. 7 with a support device in its opened state, FIG. 10 is a section similar to FIG. 9, showing the support device in its closed state, FIGS. 11 and 12 are sections on the line XI—XI in FIG. 7 before and after piercing respectively, FIGS. 13 and 14 are central longitudinal sections through the support device before and after insertion of the mandrel respectively, and FIGS. 15 and 16 are central longitudinal sections similar to FIGS. 13 and 14 but illustrating mandrels penetrating from both ends.

FIG. 1 shows a foundation 1 having a well 2. Bearers 3 are laid over the well 2 parallel to one another. Only one of these bearers is visible in FIG. 1. A chill mould support 4 which is disposed between these bearers 3 and supported thereon by bearings 5 can be tilted in a vertical plane. The chill mould support 4 can be tilted from the vertical casting position shown in FIG. 1 into a horizontal position (FIG. 2) by means of a lever 6 which is actuated by a power cylinder 7. Of course, it is also possible for the chill mould support 4 to assume inclined positions.

A chill mould 8 for accommodating the molten metal is inserted into the chill mould support 4. The molten material is poured from above out of a ladle 9, which is suspended on a crane hook 10. In place of the ladle shown having a spout, it is also possible for a stoppered ladle to be used. Moreover, the molten material can also be guided directly from the furnace into the chill mould 8 by way of a trough or the like.

FIGS. 2 and 3 show how the chill mould 8 is mounted in the chill mould support 4. On its two end portions — and in the case of longer chill moulds possibly also on the middle longitudinal portion — the chill mould 8 has tyres 11, which rest against wheels 12 having flanges 12*a* and drivable by means of a motor 13 by way of a gear box 14. The chill mould 8 then turns about its longitudinal axis but at a relatively low speed so that no appreciable centrifugal forces are produced. During rotation the chill mould 8 is guided in an axial direction by the wheel flanges 12*a* on the wheels 12. In addition the latter held the chill mould in the radial direction, but owing to their arrangement make it possible for the chill mould 8 to be replaced. To this end the upper wheels 12*b* in FIG. 3 can be removed by releasing the keyed joints 4*a*.

As shown in FIGS. 4 to 6, the chill mould 8 is provided with a detachable cover 15 and a base 16 which is also detachable. In order to afford rapid release of both the cover 15 and the base 16, they are both attached to means of keyed joints to the main body of the chill mould 8. The main body of the chill mould 8, which accommodates the molten material, has an inner cross section which is approximately square in form. Of course, it is also possible to have other cross sectional shapes, just as it is possible to use different closure mechanisms for the cover 15 and the base 16.

As is shown in FIG. 1 the fluid molten material is poured into a chill mould 8 which is standing virtually vertical, and the cover 15 is placed in position immediately, thus sealing off the chill mould 8. Immediately subsequent to this, the power cylinder 7 is actuated so that the chill mould is tilted into a horizontal position (FIG. 2) where it then rotates slowly about its axis and possibly also carries out a pendulum movement about a large angle. When the molten material has cooled sufficiently for a border region of adequate firmness to form, both the cover 15 and the lid 16 are removed. The cast piece, which in its core region is still viscous or even fluid, is forced out of the chill mould 8 onto a roller conveyor 18 by means of a pusher 17 (FIG. 2). The roller conveyor 18 conveys the cast piece to the piercing device of FIG. 7 which is disposed as near as possible to the casting device of FIG. 1. The cast piece is pushed at right angles to its longitudinal direction by other pushers 19 over a table comprising support beams 20 and into a receptacle 21. As is shown in FIG. 9, the receptacle 21 is of the chill mould type and is split longitudinally and can be opened up about hinges 22, by means of piston rod and lever 23 and a power cylinder 24. A stop 25 ensures that the half of the receptacle 21 which has been opened up cannot be swung too far away from the stationary half. As soon as the cast piece has been inserted into that half of the receptacle 21 which has been swung down, the receptacle is closed by means of the power cylinder 24, as is shown in FIG. 10.

It can be seen from FIG. 11 that the chill mould type receptacle 21 has an inner diameter which corresponds approximately to the circumference of the cross section of the chill mould 8. Cavities 26 are thus produced, into which the cast piece is displaced as shown in FIG. 12 during the piercing process which is carried out directly after the insertion of the cast piece into the receptacle 21.

A mandrel 27, whose drive can be seen in FIG. 7 serves to effect piercing. The mandrel 27 is attached to a crosshead 29 by means of a mandrel locking mechanism 28, which enables easy replacement of the mandrel 27. A plurality of nuts 30, each of which engages with a screw threaded spindle 31, is provided in the crosshead 19. The end portions of the threaded spindles 31 are mounted in bearings 32 and are driven by a motor 35 by way of clutches 33 and a gear box 34. In this manner the crosshead 29 and thus also the mandrel 27 can be moved axially, the crosshead 29 being faultlessly guided in a frame 36 of the device, as indicated in FIG. 8.

At its free front end portion, the mandrel is guided by guiding members 37 to ensure absolutely central penetration of the cast piece by the tip of the mandrel. The penetration of the cast piece by the mandrel 27 is shown in FIGS. 13 and 14. In these FIGS. it can also clearly be seen that the end of the receptacle 21 remote from the mandrel 27 is closed off with a cover 38, which does however have a bore 39 which corresponds to the diameter of the mandrel 27. The cover 38 is attached to a holder 40, which, as is shown in FIG. 7, can be displaced at right angles to the longitudinal direction of the mandrel 27 by means of a spindle 41 and a motor 42. In the first place this makes it possible for the receptacle 21 to be closed off during the piercing process, in that the bore 39 is displaced to the side such that it lies outside the region of the cast piece, and the cover 38, which is in the form of a slide, closes off the support device 21. The displaced material of the cast piece is forced in an axial direction during piercing and out of the other aperture of the receptacle 21, which aperture has remained open; this process is shown in FIG. 14. As soon as the mandrel 27 approaches the cover 38, the latter can be returned to the position shown in FIG. 13 so that the mandrel 27 can enter the bore 39, as shown in FIG. 14, and the cast piece can be piereced throughout its entire length.

When the piercing process has been completed, the mandrel 27 is withdrawn and the cover 38 together with its mounting 40 is moved completely to the side, so that the finished tubular bloom can be pushed out, possibly with the aid of the mandrel 27, in an axial direction onto a roller conveyor (not shown).

As is shown in FIGS. 15 and 16, it is also possible to effect piercing from both ends by means of two mandrels 27, which then of course requires a drive device 28 to 36 for the mandrels to be disposed at both ends. It is then possible for the finished tubular blooms to be thrown out of the receptacle at right angles to their longitudinal direction, towards the side facing away from the roller conveyor 18. For this reason it would of course be necessary and more advantageous for the construction of the closure mechanism of the receptacle to be somewhat different from that in FIGS. 9 and 10. It would then be advantageous for the part shown as stationary in FIGS. 9 and 10 of the receptacle likewise to be swung down and possibly for it to be equipped as a raising member to effect depositing on a means of transport (not shown).

While certain preferred embodiments and practices of this invention have been set out in the above specification it will be apparent that this invention may be otherwise embodied within the scope of the following claims.

What is claimed is:

1. A process for producing a long tubular bloom having a length to diameter ratio in excess of 20:1 comprising the steps of:

(a) pouring molten material into a chill mould whose longitudinal axis is transverse to the horizontal and having a mould opening with a length to diameter ratio in excess of 20:1;

(b) sealing the chill mould immediately after pouring the molten material is completed;

(c) tilting the chill mould to a generally horizontal axial position as soon as sealed;

(d) rotating the mould about its longitudinal axis from a time not later than the time the mould assumes the horizontal axial position until a generally uniform peripheral wall of substantially solidified metal has formed having an axial core which is at least partially viscous;

(e) inserting at least one mandrel into the material in the chill mould along the longitudinal axis of said mould while the material along said axis is at least partially viscous, said mandrel being in contact with the metal throughout its inserted length;

(f) guiding said mandrel during insertion solely by the substantially solidified metal of the peripheral wall surrounding the axial portion;

(g) transferring the material from the mould along with the axial mandrel to a forming operation;

(h) processing the material around the mandrel to form a tube; and (i) removing the mandrel from the completed tube.

2. A process as claimed in claim 1 in which the chill mould has a non-circular cross-sectional form and in which the cast piece is transferred from the chill mould, when the cross-sectional border region has solidified sufficiently, into a chill mould type receptacle having a circular cross-sectional form of diameter substantially the same as the largest cross-sectional dimension of the non-circular cross section and thereafter piercing the cast piece with the mandrel.

3. A process as claimed in claim 1 in which the still viscous material of the axis of the material in the mould is displaced substantially in a radial direction as the mandrel is inserted.

4. A process as claimed in claim 1 in which the still viscous material of the axis of the material is displaced substantially in an axial direction as the mandrel is inserted.

5. A process as claimed in claim 3 in which two mandrels are inserted simultaneously into opposite ends of the cast piece.

6. A process as claimed in claim 5, in which subsequent to the meeting of the confronting faces of the two mandrels in the middle longitudinal portion of the cast piece, at least one of the mandrels is inserted further into the cast piece such that it extends slightly beyond this point of contact, and the other mandrel is withdrawn by a corresponding amount.

7. A process as claimed in claim 1 in which the pouring of the molten metal into the chill mould is effected at high speed.

8. A process as claimed in any of claim 1 in which the device for further processing comprises a releasing mill.

9. A process as claimed in any of claim 1 in which the device for further processing comprises a skew rolling mill.

10. A process as claimed in claim 2 in which the chill mould has a square section.

* * * * *

UNITED STATES PATENT OFFICE

CERTIFICATE OF CORRECTION

Patent No. 4,091,524 Dated May 30, 1978

Inventor(s) Friedrich Kocks, deceased

It is certified that error appears in the above-identified patent and that said Letters Patent are hereby corrected as shown below:

Column 1, line 63, "Thses" should be --These--.

Column 3, line 23, "efffected" should be --effected--.

Column 4, line 40, "veiw" should be --view--.

Column 6, line 13, "19" should be --29--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*